US011091961B2

(12) United States Patent
Bolen et al.

(10) Patent No.: US 11,091,961 B2
(45) Date of Patent: Aug. 17, 2021

(54) SYSTEMS AND METHODS FOR MULTI-ACTIVITY ONSHORE FIELD DEVELOPMENT

(71) Applicant: Chevron U.S.A. Inc., San Ramon, CA (US)

(72) Inventors: Matthew Scott Bolen, The Woodlands, TX (US); Kenneth Eric Hodges, Houston, TX (US); Steven Thomas Bowman, Houston, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 16/738,174

(22) Filed: Jan. 9, 2020

(65) Prior Publication Data

US 2021/0215004 A1 Jul. 15, 2021

(51) Int. Cl.
*E21B 15/00* (2006.01)
*E21B 19/08* (2006.01)

(52) U.S. Cl.
CPC ..... *E21B 15/003* (2013.01); *E21B 19/08* (2013.01)

(58) Field of Classification Search
CPC ..... E21B 15/00; E21B 15/003; E21B 19/08
See application file for complete search history.

(56) References Cited

U.S. PATENT DOCUMENTS 4,590,720 A * 5/1986 Reed ..... E04H 12/182 254/336
4,819,730 A * 4/1989 Williford ..... E21B 7/128 114/144 B
6,047,781 A 4/2000 Scott et al.
7,377,335 B2 * 5/2008 Jones ..... E21B 15/003 166/381
7,461,831 B2 * 12/2008 Mosley ..... E21B 7/023 254/277
7,628,224 B2 * 12/2009 D'Souza ..... B63B 35/44 175/5
7,828,086 B2 * 11/2010 Lesko ..... E21B 7/023 175/203
8,256,520 B2 * 9/2012 Lucas ..... E21B 15/02 166/352
8,342,249 B2 * 1/2013 Payne ..... E21B 15/02 166/358
8,733,472 B2 * 5/2014 Magnuson ..... E21B 19/143 175/7
9,834,998 B2 * 12/2017 Holck ..... E21B 19/084
10,196,860 B2 * 2/2019 Wright ..... E21B 15/003
(Continued)

*Primary Examiner* — Matthew R Buck
(74) *Attorney, Agent, or Firm* — King & Spalding LLP

(57) ABSTRACT

A system for developing multiple subterranean wellbores in a land-based field can include a first operational platform disposed over a first entry point of a first subterranean wellbore at a first time. The system can also include a second operational platform disposed over a second entry point of a second subterranean wellbore at the first time, where the first entry point and the second entry point are located proximate to each other. The system can further include first field equipment disposed on the first operational platform. The system can also include a second field equipment disposed on the second operational platform. The first field equipment can be used to develop the first subterranean wellbore, and the second field equipment can be used to develop the second subterranean wellbore.

19 Claims, 6 Drawing Sheets

(56) References Cited

U.S. PATENT DOCUMENTS

| | | | | |
|---|---|---|---|---|
| 10,801,270 | B2 * | 10/2020 | Plano | E02B 17/021 |
| 2010/0108322 | A1 * | 5/2010 | Eilertsen | E21B 15/02<br>166/352 |

* cited by examiner

SYSTEMS AND METHODS FOR MULTI-ACTIVITY ONSHORE FIELD DEVELOPMENT

TECHNICAL FIELD

The present application relates to field operations, and in particular, methods and systems of multi-activity onshore field development.

BACKGROUND

When multiple wells are drilled from the same location, one well is drilled at a time. Also, time is spent transitioning equipment from a well that has just been drilled to the location of the next well to be drilled. A significant amount of money, in terms of time and labor, is spent during these transitions. These transitions also increase the risk of accidents and safety threats to personnel.

SUMMARY

In general, in one aspect, the disclosure relates to a system for developing multiple subterranean wellbores in a land-based field. The system can include a first operational platform disposed over a first entry point of a first subterranean wellbore at a first time. The system can also include a second operational platform disposed over a second entry point of a second subterranean wellbore at the first time, where the first entry point and the second entry point are located proximate to each other. The system can further include first field equipment disposed on the first operational platform. The system can also include second field equipment disposed on the second operational platform. The first field equipment can be used to develop the first subterranean wellbore, and the second field equipment can be used to develop the second subterranean wellbore.

These and other aspects, objects, features, and embodiments will be apparent from the following description and the appended claims.

BRIEF DESCRIPTION OF THE DRAWINGS

The drawings illustrate only example embodiments of methods, systems, and devices for facilitating multi-activity onshore field development and are therefore not to be considered limiting of its scope, as facilitating multi-activity onshore field development may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1:
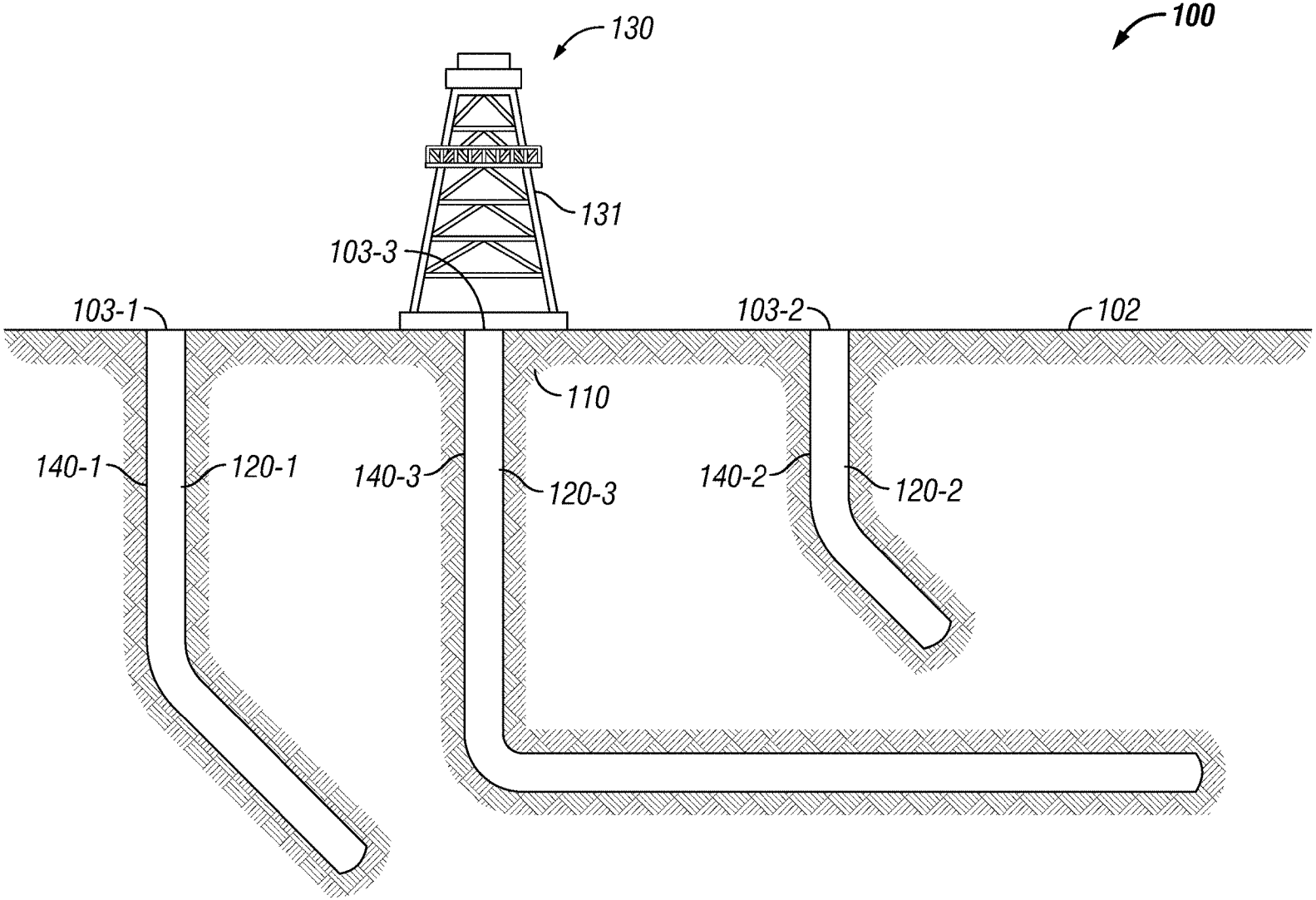
FIG. 1 (Prior Art)
FIG. 1 shows a field system having multiple wellbores in accordance with the current art.

The example embodiments discussed herein are directed to systems, apparatuses, and methods for facilitating multi-activity onshore field development. While the example embodiments shown in the Figures and described herein are directed to multi-hole field development to extract hydrocarbon resources from a subterranean formation, example embodiments can additionally or alternatively be used for multi-hole field development in the extraction of one or more other resources (e.g., water, geothermal resources) from a subterranean formation.

A user as described herein may be any person that is involved in a field operation involving one or more wellbores in a subterranean formation. Examples of a user may include, but are not limited to, a company (e.g., an oil and gas company), a company representative, a drilling engineer, a driller, a tool pusher, a service hand, a field engineer, an electrician, a mechanic, an operator, a consultant, a contractor, a roughneck, and a manufacturer's representative. As defined herein, a field can be a location, a geographic area, one or more projects, and/or any other suitable designation. A field can include a vertical profile that can include a surface, extend to some depth within a subterranean formation below the surface, and/or extend into the air above the surface.

In certain example embodiments, the systems and methods described herein can be subject to meeting certain standards and/or requirements. For example, the Occupational Safety and Health Administration (OSHA), the Bureau of Land Management (BLM), the Bureau of Safety and Environmental Enforcement (B SEE), and the Environmental Protection Agency (EPA) set standards as to the exploration, development, and/or production of subterranean resources in a field. Use of example embodiments described herein meet such standards when required.

If a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. The numbering scheme for the various components in the figures herein is such that each component is a three-digit number or a four-digit number, and corresponding components in other figures have the identical last two digits. For any figure shown and described herein, one or more of the components may be omitted, added, repeated, and/or substituted. Accordingly, embodiments shown in a particular figure should not be considered limited to the specific arrangements of components shown in such figure.

Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Example embodiments of facilitating multi-activity onshore field development will be described more fully hereinafter with reference to the accompanying drawings, in which example embodiments of facilitating multi-activity onshore field development are shown. Facilitating multi-activity onshore field development may, however, be embodied in many different forms and should not be construed as limited to the example embodiments set forth herein. Rather, these example embodiments are provided so that this disclosure will be thorough and complete, and will fully convey the scope of facilitating multi-activity onshore field development to those or ordinary skill in the art. Like, but not necessarily the same, elements (also sometimes called components) in the various figures are denoted by like reference numerals for consistency.

Terms such as "first", "second", "above", "below", and "within" are used merely to distinguish one component (or part of a component or state of a component) from another. Such terms are not meant to denote a preference or a particular orientation, and such terms are not meant to limit embodiments of facilitating multi-activity onshore field development. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

FIG. 1 shows a field system 100 having multiple (in this case, three) wellbores 120 in accordance with the current art. Specifically, wellbore 120-1 and wellbore 120-2 have already been drilled and completed, and wellbore 120-3 is actively being developed. Each wellbore 120 is formed in the subterranean formation 110 using field equipment 130 located above the surface 102. The point where a wellbore 120 begins at the surface 102 can be called the entry point 103. In this case, entry point 103-1 represents the top of the wellbore 120-1, entry point 103-2 represents the top of the wellbore 120-2, and entry point 103-3 represents the top of the wellbore 120-3. A site with multiple wellbores 120 can be referred to in the industry as a pad.

The subterranean formation 110 can include one or more of a number of formation types, including but not limited to shale, limestone, sandstone, clay, sand, and salt. In certain embodiments, a subterranean formation 110 can also include one or more reservoirs in which one or more subterranean resources (e.g., oil, gas, water, steam) can be located. One or more of a number of field operations (e.g., drilling, setting casing, extracting production fluids) can be performed to reach an objective of a user with respect to the subterranean formation 110.

To accomplish the objective, multiple wellbores 120 are sometimes drilled and completed, where the entry points 103 of the wellbores 120 are relatively close to each other at the surface 102. In other words, the distance between entry point 103-1 and entry point 103-2, the distance between entry point 103-2 and entry point 103-3, and the distance between entry point 103-1 and entry point 103-3 can be relatively small (e.g., 50 feet, 100 feet, 10 feet).

Typically, these distances between entry points 103 are relatively small to ease the production process in extracting the subterranean resources, so that one or more pieces of field equipment (e.g., piping, pumps, generators, processing units) can be centrally located and more easily used with the subterranean resources extracted from some or all of the wellbores 120. Having small distances between entry points 103 also reduces the amount of work required to move the field equipment 130 from one wellbore 120 to a location where the next wellbore 120 is to be drilled.

Each wellbore 120 can have one or more of a number of segments that collectively form the wellbore 120, where each segment can have one or more of a number of dimensions. Examples of such dimensions can include, but are not limited to, a size (e.g., diameter) of the wellbore 120, a curvature of the wellbore 120, a total vertical depth of the wellbore 120, a measured depth of the wellbore 120, and a horizontal displacement of the wellbore 120. The field equipment 130 can be used to create and/or develop (e.g., drill to extend the wellbore 120, set casing 140, insert a working fluid into, extract production fluids from) the wellbore 120. The field equipment 130 can be positioned and/or assembled at the surface 102. The field equipment 130 can include, but is not limited to, one or more derricks 131, one or more tool pushers, one or more clamps, one or more tongs, drill pipe, one or more drill bits, one or more slips, one or more injection devices, completion equipment, centralizers, tubing pipe (also simply called tubing), one or more generators, one or more motors, one or more pumps, one or more tanks, one or more packers, one or more snubbing units, one or more wireline units, one or more coil-tubing units, tubing string, and casing 140.

Each wellbore 120 in this case is lined with casing 140. Specifically, wellbore 120-1 is lined with casing 140-1, wellbore 120-2 is lined with casing 140-2, and wellbore 120-3 is lined with casing 140-3. The casing 140 can include a number of casing pipes that are mechanically coupled to each other end-to-end, usually with mating threads. The casing pipes of a casing 140 can be mechanically coupled to each other directly or using a coupling device, such as a coupling sleeve. Each casing pipe of the casing 140 can have a number of different sections that each has a length and a width (e.g., outer diameter). For example, casing pipe that is positioned in a wellbore 120 closer to the surface 102 can be wider (have a larger diameter) than casing pipe positioned further into the wellbore 120.

Casing pipe having a substantially similar size can be called a section of casing 140. Each section of casing 140 can include any of a number of casing pipes. Between casing sections, the length and/or width of a casing pipe can vary. For example, a common length of a casing pipe is approximately 30 feet. The length of a casing pipe can be longer (e.g., 60 feet) or shorter (e.g., 10 feet) than 30 feet. The cross-sectional shape of the casing pipe is typically circular, and so the width of a casing pipe can be stated, for example, in terms of an outer diameter and/or an inner diameter of the casing pipe. Examples of a width in terms of an outer diameter of a casing pipe can include, but are not limited to, 7 inches, 7⅝ inches, 8⅝ inches, 9⅝ inches, 10¾ inches, 13⅜ inches, and 14 inches.

The size (e.g., width, length) of the casing 140 can be based on the information gathered using field equipment 130 with respect to the wellbore 120 in the subterranean formation 110. The walls of the casing 140 have an inner surface that forms a cavity that traverses the length of the casing 140. The casing 140 can be made of one or more of a number of suitable materials, including but not limited to steel. In certain example embodiments, the casing 140 is set along substantially all of the length of the wellbore 120.

The field equipment 130 can also include one or more devices that measure and/or control various aspects (e.g., direction, pressure, temperature) of a field operation associated with the wellbore 120. For example, the field equipment 130 can include a wireline tool that is run through the wellbore 120 to provide detailed information (e.g., curvature, azimuth, inclination) throughout the wellbore 120. Such information can be used for one or more of a number of purposes. For example, such information can dictate the size (e.g., outer diameter) of a casing pipe 140 to be inserted at a certain depth in the wellbore 120. During the production phase of an operation to extract resources (e.g., hydrocarbons) from the subterranean formation 110 of a field 100, one or more of a number of operations can take place to enhance the amount of resources extracted from the subterranean formation 110.

For a land-based field with multiple wellbores 102 in the current art, as in this example, each wellbore 102 is drilled one at a time. As a result, even though the entry points 103 (in this case, entry point 103-1 for wellbore 120-1, entry point 103-2 for wellbore 120-2, and entry point 103-3 for wellbore 102-3) are close to each other (e.g., within 50 feet), much of the field equipment 130 (e.g., the derrick 131, the tongs, the clamps, the drill pipe) need to be relocated before drilling of a new wellbore 120 can begin. Also, the piping for the mud circulation lines, conduit for the electrical equipment, and other adjustments to stationary equipment need to be modified. All of this results in a tremendous amount of time and work to prepare for drilling a new wellbore 120 in the field. Example embodiments greatly reduce or eliminate the need to reposition and/or reconfigure the field equipment 130 for each new wellbore 120 drilled at the field.

Figure 2:
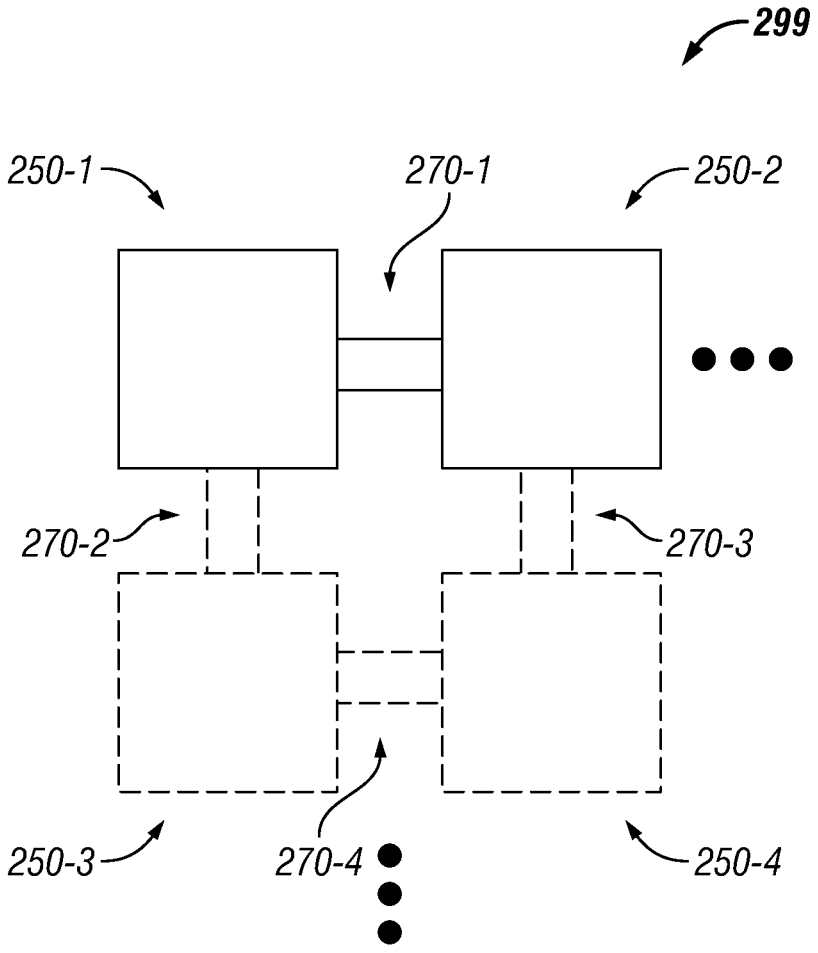
FIG. 2 shows a system having multiple example operational platforms in accordance with certain example embodiments.

FIG. 2 shows a system 299 having multiple example operational platforms 250 in accordance with certain example embodiments. Referring to FIGS. 1 and 2, the system 299 of FIG. 2 includes example operational platform 250-1, example operational platform 250-2, optional example operational platform 250-3, and optional example operational platform 250-4. There can also be one or more additional operational platforms (not shown in FIG. 2) that can expand in any direction (e.g., up, down, left, right, upper-left, lower-right) relative to operational platform 250-1 through operational platform 250-4. Each operational platform 250 can be configured substantially the same as each other. Alternatively, at least one operational platform 250 can be configured (e.g., in terms of length, in terms of width, in terms of location of equipment, in terms of location of mouse hole) differently than one or more of the other operational platforms 250.

Additionally, or alternatively, the multiple operational platforms 250 of the system 299 can have any of a number of orientations with respect to each other. For example, operational platform 250-1 and operational platform 250-2 can be arranged as mirror images of each other. As another example, operational platform 250-1 and operational platform 250-2 can be arranged in the same orientation with respect to each other. As still another example, operational platform 250-1 can be rotated 90° clockwise with respect to operational platform 250-2, which can be rotated 90° clockwise with respect to operational platform 250-3 which can be rotated 90° clockwise with respect to operational platform 250-4, which can be rotated 90° clockwise with respect to operational platform 250-1.

In this case, each operational platform 250 has a square shape when viewed from above, as shown in FIG. 2. An operational platform can alternatively have one or more of a number of other shapes when viewed from above, including a circle, an oval, a rectangle, a triangle, an octagon, and a hexagon. Also, in this case, all of the operational platforms 250 of the system 299 have the same size (e.g., length, width). Alternatively, as discussed above, one operational platform 250 can have one or more different size dimensions relative to one or more of the other operational platforms 250 in the system 299.

Disposed between adjacent operational platforms 250 can be one or more transition platforms 270. In this case, the system 299 has a transition platform 270-1 disposed between operational platform 250-1 and operational platform 250-2, an optional transition platform 270-2 disposed between operational platform 250-1 and operational platform 250-3, an optional transition platform 270-3 disposed between operational platform 250-2 and operational platform 250-4, and an optional transition platform 270-4 disposed between operational platform 250-3 and operational platform 250-4.

A transition platform 270 can be a fixed length. Alternatively, a transition platform 270 can have an adjustable length (e.g., have telescopic features). Similarly, a transition platform 270 can have a fixed width or an adjustable width. A transition platform 270 can be used to allow passage of personnel and/or equipment to transfer between the platforms 250 to which the transition platform 270 is coupled. A transition platform 270 can be coupled to two adjacent operational platforms 250 (as shown in FIG. 2). Alternatively, a transition platform 270 can be coupled to three or more adjacent operational platforms 250. In such a case, the transition platform 270 can be T-shaped, X-shaped, or have some other shape other than a linear shape when viewed from above.

As shown in FIG. 2, there can be a single transition platform 270 disposed between two adjacent operational platforms 250. Alternatively, there can be multiple transition platforms 270 disposed between two adjacent operational platforms 250. In this case, each transition platform 270 is disposed at the approximate center of each facing side of two adjacent operational platforms 250. A transition platform 270 can also be placed at any other point along a facing side of an operational platform 250.

Example embodiments can also allow for some or all of the system 299 to be moved or "walked" when one phase of a field operation has been completed so that another phase can begin. For example, if the system 299 consists of operational platform 250-1, operational platform 250-2, and transition platform 270-1, when the wells located below operational platform 250-1 and operational platform 250-2 have been completed, and if wells located where the outlines for operational platform 250-3 and operational platform 250-4 are next to be drilled or otherwise developed, then operational platform 250-1, operational platform 250-2, and transition platform 270-1 can be moved as a group downward as a group so that work on the new wells can begin.

As another example, if the system 299 consists of operational platform 250-1, operational platform 250-2, and transition platform 270-1, when the wells located below operational platform 250-1 has been completed while the well located below operational platform 250-2 continues to be developed, and if a well located where the outline for operational platform 250-4 is next to be drilled or otherwise developed, then operational platform 250-1 can be moved to where the outline for operational platform 250-4 is located, and transition platform 270-1 can be moved to where the outline for transition platform 270-3 is located. More details about the operational platforms 250 and the transition platforms 270 are discussed below with respect to FIGS. 3A through 3C.

Figure 3A:
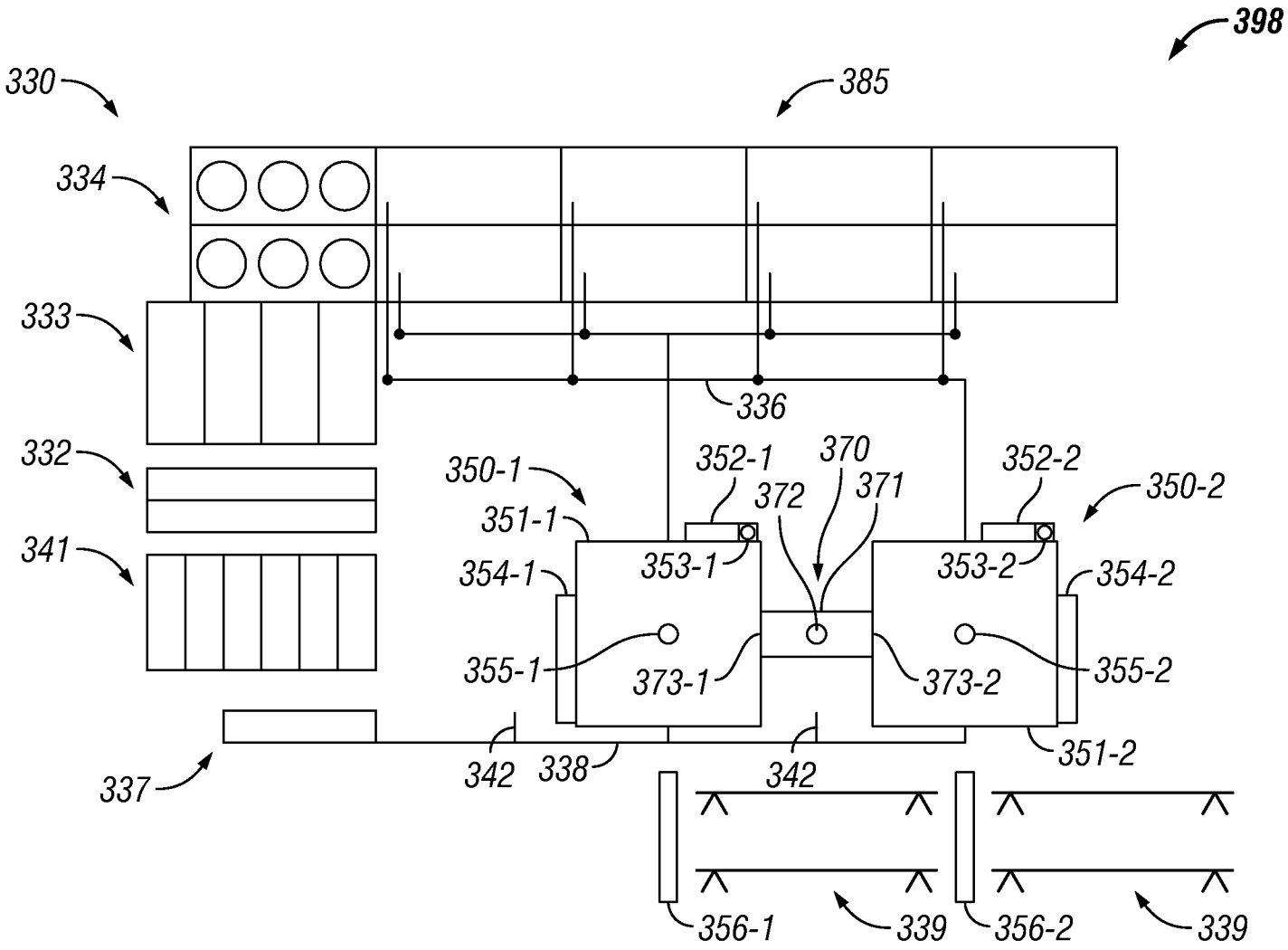
FIGS. 3A through 3C show another system having two example operational platforms in accordance with certain example embodiments.
Figure 3B:
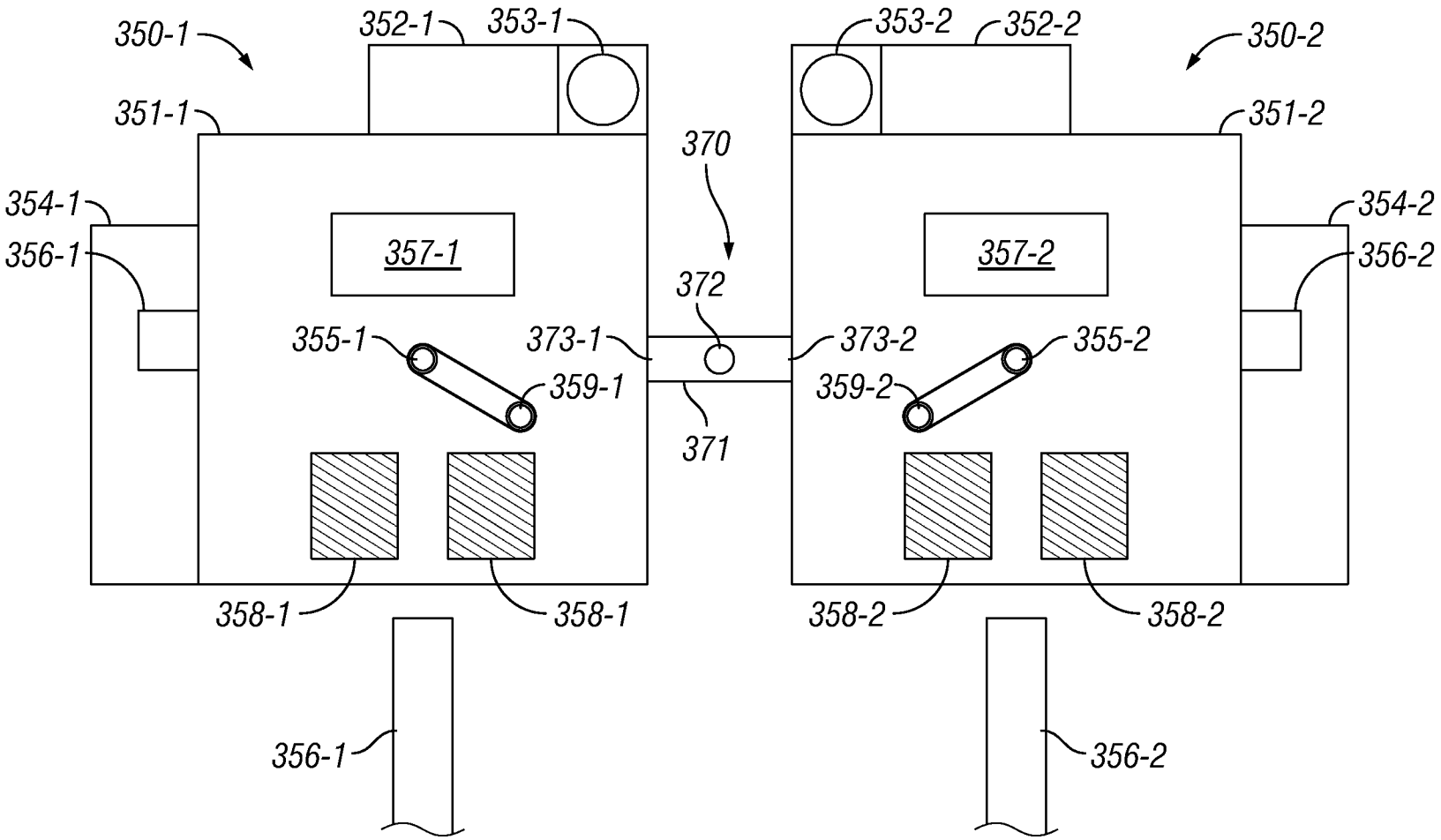
Figure 3C:
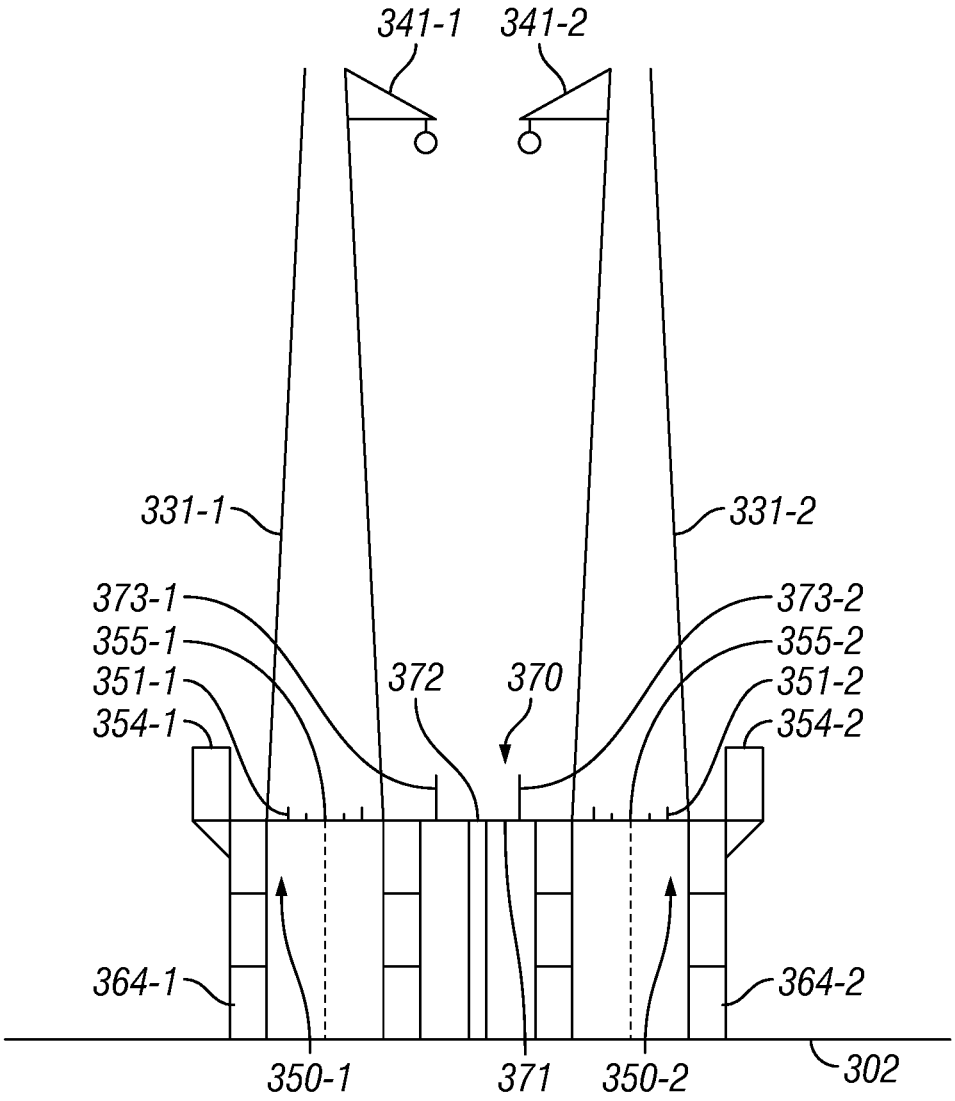

FIGS. 3A through 3C show another system 398 having two example operational platforms 350 in accordance with certain example embodiments. FIG. 3A shows a top view of the system 398. FIG. 3B shows a top view of part of the system 398 of FIG. 3A. FIG. 3C shows a side view of part of the system 398 of FIG. 3A. The view in FIG. 3C includes a derrick 331, not shown in FIGS. 3A and 3B, for each operational platform 350 (derrick 331-1 for operational platform 350-1 and derrick 331-2 for operational platform 350-2).

In certain example embodiments, as shown in FIG. 3C, derrick 331-1 has a lifting mechanism 341-1 disposed at its upper end, and derrick 331-2 has a lifting mechanism 341-2 disposed at its upper end. Each lifting mechanism 341 can be used to move one or more pieces of field equipment 330 located on or proximate to the respective operational platform 350. Each lifting mechanism 341 can have a range of motion (e.g., rotate about a vertical axis, be raised and lowered vertically, telescope inward and outward) to help more precisely move the field equipment 330.

Referring to FIGS. 1 through 3C, operational platform 350-1 and operational platform 350-2 are joined by transitional platform 370, which is a linear segment that is adjoined along the middle of each side of operational platform 350-1 and operational platform 350-2 facing each other. In this case, the transitional platform 370 serves, at least in part, as a walkway. The transitional platform 370 has one or more of a number of features. For example, as shown in FIGS. 3A through 3C, the transitional platform 370 has a body 371 and at least one aperture 372 disposed therethrough. The aperture 372 can serve as a mouse hole, as that term is used in the art. FIGS. 3A through 3C also show that there is an optional safety gate 373 disposed at each end of the body 371. Specifically, safety gate 373-1 is disposed at the end of the body 371 coupled to operational platform 350-1, and safety gate 373-2 is disposed at the other end of the body 371 coupled to operational platform 350-2.

In certain example embodiments, for safety reasons, the lifting mechanisms 341 of the derricks 331 are not long enough to extend to an adjacent operational platform 350. For example, the lifting mechanism 341-1 of derrick 331-1 of operational platform 350-1 is designed to not be able to extend to any part of the body 351-2 of operational platform 350-2. Alternatively, the lifting mechanism 341-1 of derrick 331-1 of operational platform 350-1 and the lifting mechanism 341-2 of derrick 331-2 of operational platform 350-2 are designed to not be able to extend so far as to overlap each other. In such a case, the mouse hole 372 in the body 371 of the transitional platform 370 can be used to serve as a transfer point between lifting mechanism 341-1 and lifting mechanism 341-2.

In this case, operational platform 350-1 and operational platform 350-2 are mirror images of each other. Operational platform 350-1 includes one or more of a number of features and/or components. For example, operational platform 350-1 has a body 351-1 that is substantially square in shape when viewed from above. The body 351-1 of the operational platform 350-1 has one or more apertures disposed therethrough. For example, in this case, the body 351-1 has an aperture 355-1 used for operations (e.g., drilling, extraction, production) and another aperture 359-1 that serves as a mouse hole, as that term is used in the art. Aperture 359-1 is located adjacent to aperture 355-1, which is disposed in the approximate center of the body 351-1.

One or more pieces of field equipment 330 used in a field operation can be disposed on the operational platform 350-1. For example, disposed on the body 351-1 in this case are two racking boards 358-1 and a draw works stand 357-1. Also, one or more platform extensions can extend from one or more sides of the body 351-1. These extensions can be used to have disposed thereon additional field equipment 330 used in a field operation. For example, in this case, one extension on which a driller's shack 354-1 and a driller's stand 356-1 are disposed can extend from a side of the body 351-1 opposite the transitional platform 370, and another extension on which a choke manifold 352-1 and a mud-gas separator 353-1 (MGS 353-1) are disposed can extend from another side of the body 351-1 adjacent to the transitional platform 370. Each extension can be part of the body 351-1 of the operational platform 350-1. Alternatively, an extension can be a separate piece or component that is physically attached (e.g., welded, coupled using fastening devices) to the body 351-1 of the operational platform 350-1.

One or more pieces of field equipment 330 used in a field operation can be located adjacent to the operational platform 350-1. Such field equipment 330 can be dedicated to operations performed using the operational platform 350-1. Alternatively, such field equipment 330 can be shared between both operational platform 350-1 and operational platform 350-2. For example, adjacent to a side (in this case, the side opposite the extension that includes the choke manifold 352-1 and the MGS 353-1) of the operational platform 350-1 is a pipe handler 356-1 that is dedicated to operations performed using operational platform 350-1.

As another example, as shown in FIG. 3A, one or more (in this case, six) generators 341, one or more (in this case, two) breaker panels 332, one or more (in this case, four) pumps 333, one or more (in this case, six) mixing tanks 334, one or more (in this case, eight) mud tanks 385, a network of piping 336 for facilitating the flow of mud, a cement unit 337, a network of piping 338 for facilitating the flow of wet cement, and one or more (in this case, two) tie-on points 342 are shared in operations performed using operational platform 350-1 and operational platform 350-2.

The network of piping 338 for the flow of wet cement and the network of piping 336 for the flow of mud can include a manifold system and a valve system to more easily distribute wet cement and mud, respectively, to multiple operational platforms 350, whether separately or simultaneously. All of the equipment and components listed above (e.g., transitional platform 370, operational platform 350-1, choke manifold 352-1, driller's stand 356-1, mud tanks 385, cement unit 337, draw works stand 357-1, derrick 331-1, lifting mechanism 341-1), whether shared among multiple operational platforms 350 or dedicated to a particular operational platform 350, can generally be referred to as field equipment 330.

Since operational platform 350-2 in this case is a mirror image of operational platform 350-1, the configuration and associated field equipment 330 of operational platform 350-2 is substantially similar to that of operational platform 350-1. For example, operational platform 350-2 has a body 351-2 that is substantially square in shape when viewed from above. The body 351-2 of the operational platform 350-2 has one or more apertures disposed therethrough. For example, in this case, the body 351-2 has an aperture 355-2 used for operations (e.g., drilling, extraction, production) and another aperture 359-2 that serves as a mouse hole, as that term is used in the art. Aperture 359-2 is located adjacent to aperture 355-2, which is disposed in the approximate center of the body 351-2.

One or more pieces of field equipment 330 used in a field operation can be disposed on the operational platform 350-2. For example, disposed on the body 351-2 in this case are two racking boards 358-2 and a draw works stand 357-2. Also, one or more platform extensions can extend from one or more sides of the body 351-2. These extensions can be used to have disposed thereon additional field equipment 330 used in a field operation. For example, in this case, one extension on which a driller's shack 354-2 and a driller's stand 356-2 are disposed can extend from a side of the body 351-2 opposite the transitional platform 370, and another extension on which a choke manifold 352-2 and a mud-gas separator 353-2 (MGS 353-2) are disposed can extend from another side of the body 351-2 adjacent to the transitional platform 370. Each extension can be part of the body 351-2 of the operational platform 350-2. Alternatively, an extension can be a separate piece or component that is physically attached (e.g., welded, coupled using fastening devices) to the body 351-2 of the operational platform 350-2.

One or more pieces of field equipment 330 used in a field operation can be located adjacent to the operational platform 350-2. Such field equipment 330 can be dedicated to operations performed using the operational platform 350-2. Alternatively, such field equipment 330 can be shared between both operational platform 350-1 and operational platform 350-2. For example, adjacent to a side (in this case, the side opposite the extension that includes the choke manifold 352-2 and the MGS 353-2) of the operational platform 350-2 is a pipe handler 356-2 that is dedicated to operations performed using operational platform 350-2.

As another example, as shown in FIG. 3A, the generators 341, the breaker panels 332, the pumps 333, the mixing tanks 334, the mud tanks 385, the network of piping 336 for facilitating the flow of mud, the cement unit 337, the network of piping 338 for facilitating the flow of wet cement, and the tie-on points 342 are shared in operations performed using operational platform 350-1 and operational platform 350-2.

Figure 4:
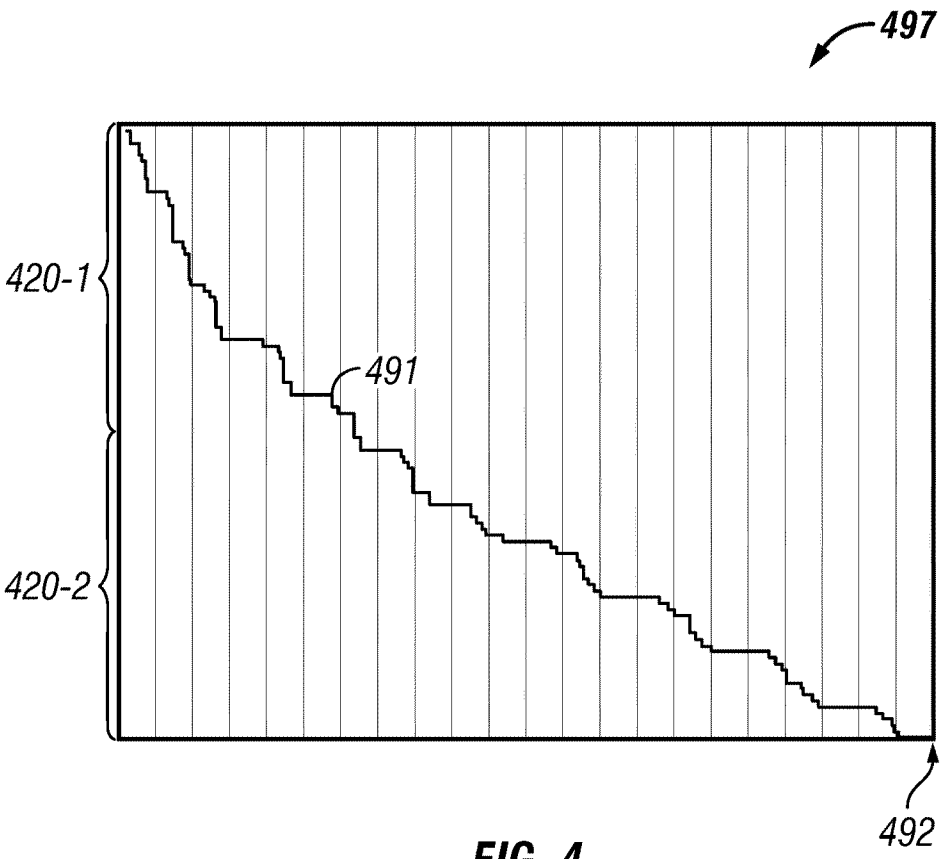
FIG. 4 (Prior Art)
FIG. 4 shows a graph of a project timeline for developing two wellbores in accordance with the current art.

FIG. 4 shows a graph 497 of a project timeline for developing two wellbores 420 in accordance with the current art. Referring to FIGS. 1 through 4, the graph 497 of FIG. 4 shows a single plot 491 of project tasks for wellbore 420-1 and wellbore 420-2 over time 492. The project tasks for wellbore 420-1 are worked on exclusively until the wellbore 420-1 is complete. Only upon the completion of wellbore 420-1 does work begin on wellbore 420-2. This entire process takes 22 increments (e.g., a week, a month) of time 492.

Figure 5:
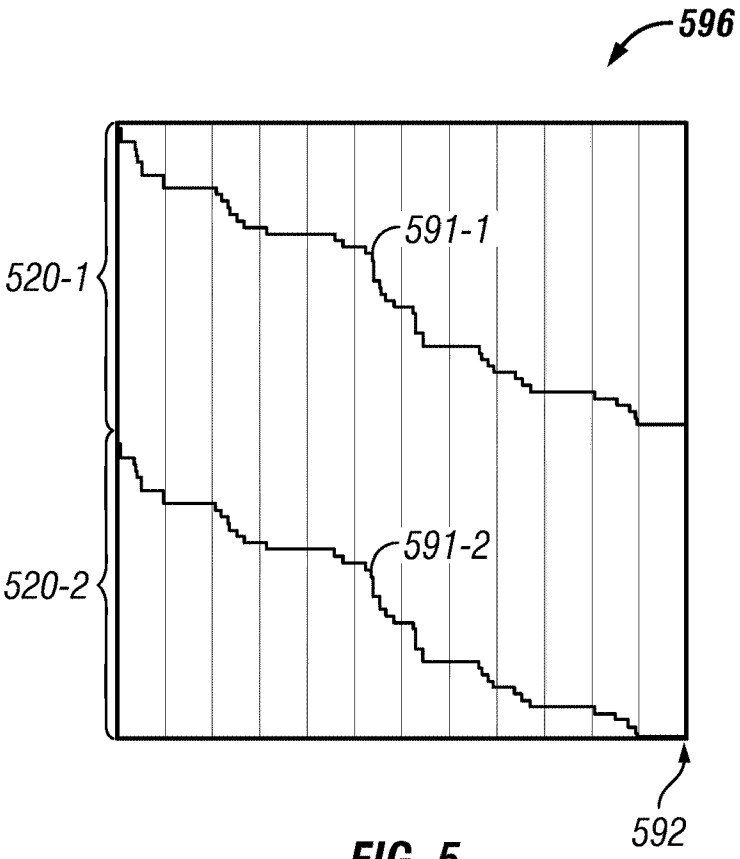
FIG. 5 shows a graph of a project timeline for developing two wellbores in accordance with certain example embodiments.

FIG. 5 shows a graph 596 of a project timeline for developing two wellbores 520 in accordance with certain example embodiments. Referring to FIGS. 1 through 5, the graph 596 of FIG. 5 shows two plots 591 of project tasks for wellbore 520-1 and wellbore 520-2 over time 592. Specifically, plot 591-1 showing the progress of the project tasks for wellbore 520-1 and plot 591-2 showing the progress of the project tasks for wellbore 520-2 run simultaneously (in parallel with each other). In other words, plot 591-1 and plot 591-2 are independent of each other. As a result, the entire process to complete both wellbores 520 takes only 11 increments (e.g., a week, a month) of time 592, which is approximately half the time 492 needed to complete both wellbores 420 using methods and systems available in the current art.

Example embodiments are used for land-based field operations with two or more wells located on a pad. In the current art in such a setting, a single rig is used to drill the multiple wells on a single pad. In such a case, the drilling sequence involves either drilling one well at a time, or "skidding" or "walking" the rig to drill the same hole section on another well. Example embodiments allow for multiple wells to be drilled simultaneously, thereby significantly reducing the time that it takes to drill all the wells on the pad. Consequently, example embodiments also shorten the time from when drilling operations start on a pad to when all the wells on the pad are put on production.

By allowing multiple wells to be drilled simultaneously, example embodiments dramatically shorten the critical path of drilling activities on a pad. In addition, aside from drilling, example embodiments allow for the simultaneous performance of one or more other phases (e.g., development work-over operations) of field operations. By allowing for shared resources and parallel path operations for multiple phases of the overall field operation on a multi-well land-based pad, example embodiments promote increased efficiency, cost savings, resource conservation, improved safety, and improved resource allocation.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A system for developing multiple subterranean wellbores in a land-based field, the system comprising:

a first operational platform disposed over a first entry point of a first subterranean wellbore at a first time;

a second operational platform disposed over a second entry point of a second subterranean wellbore at the first time, wherein the first entry point and the second entry point are located proximate to each other;

first field equipment disposed on the first operational platform;

second field equipment disposed on the second operational platform, wherein the first field equipment is used to develop the first subterranean wellbore, and wherein the second field equipment is used to develop the second subterranean wellbore, and a transition platform coupled to a first side of the first operational platform and a first side of the second operational platform, the transition platform being coplanar with an operational plane defined by the first operational platform and the second operational platform, wherein the transition platform is configured to be moved and coupled to a second side of the second operational platform.

2. The system of claim 1, further comprising:

shared field equipment disposed proximate to the first operational platform and the second operational platform, wherein the shared field equipment is used in conjunction with the first field equipment to develop the first subterranean formation and in conjunction with the second field equipment to develop the second subterranean formation.

3. The system of claim 2, wherein the shared field equipment comprises a plurality of pumps.

4. The system of claim 2, wherein the shared field equipment comprises a plurality of generators.

5. The system of claim 2, wherein the shared field equipment comprises a cement distribution system.

6. The system of claim 2, wherein the shared field equipment comprises a mud processing system.

7. The system of claim 1, wherein the transition platform has disposed therein at least one aperture disposed therethrough, wherein the at least one aperture is large enough to have disposed therein a subassembly used in development of at least one of the multiple subterranean wellbores.

8. The system of claim 7, wherein the subassembly comprises a bottom hole assembly.

9. The system of claim 1, wherein the first operational platform has a first configuration, and wherein the second operational platform has the first configuration.

10. The system of claim 9, wherein the first configuration comprises a derrick.

11. The system of claim 10, wherein the derrick has an adjustable height.

12. The system of claim 11, wherein the derrick comprises a lifting mechanism to move components used to develop at least one wellbore of the multiple subterranean wellbores.

13. The system of claim 12, wherein the lifting mechanism is further used to move at least some of the components from the first platform to the second platform.

14. The system of claim 9, wherein the first operational platform and the second operational platform are arranged as mirror images of each other.

15. The system of claim 1, wherein the first subterranean wellbore and the second subterranean wellbore are developed simultaneously.

16. The system of claim 1, further comprising:

a third operational platform disposed over a third entry point of a third subterranean wellbore at the first time, wherein the first entry point, the second entry point, and the third entry point are located proximate to each other; and third field equipment disposed on the third operational platform, wherein the third field equipment is used to develop the third subterranean wellbore.

17. The system of claim 16, wherein the first operational platform, the second operational platform, and the third operational platform are linearly aligned with respect to each other.

18. The system of claim 16, wherein the transition platform is disposed between the first operational platform and the third operational platform.

19. The system of claim 18, further comprising:

a second transition platform disposed between the second operational platform and the third operational platform.

* * * * *